US005712236A

United States Patent [19]

Bolkan et al.

[11] Patent Number: 5,712,236

[45] **Date of Patent: *Jan. 27, 1998**

[54] ALKALI METAL CLEANER WITH ZINC PHOSPHATE ANTI-CORROSION SYSTEM

[75] Inventors: Steven A. Bolkan, Hopewell; Steve Dunn, Hillsborough; Gale Byrnes, Califon, all of N.J.

[73] Assignee: Church & Dwight Co., Inc., Princeton, N.J.

[ * ] Notice: The term of this patent shall not extend beyond the expiration date of Pat. No. 5,614,027.

[21] Appl. No.: 510,413

[22] Filed: Aug. 2, 1995

[51] Int. Cl.[6] ..... C11D 7/16; C11D 3/06; C11D 3/10; C11D 7/12

[52] U.S. Cl. ..... 510/259; 510/255; 510/258; 510/261; 510/265; 510/266; 510/271; 510/421; 510/423; 510/433; 510/434; 510/435; 510/437; 510/476; 510/492; 510/500; 510/508; 510/510; 510/512

[58] Field of Search ..... 510/259, 510, 510/512, 261, 265, 266, 245, 252, 254, 255, 258, 271, 421–3, 433–5, 437, 476, 477, 478, 488, 492, 500, 503, 508

[56] References Cited

U.S. PATENT DOCUMENTS

| | | | |
|---|---|---|---|
| 221,200 | 11/1879 | Wahl et al. | 510/259 |
| 674,593 | 5/1901 | Bartelt | 510/339 |
| 1,260,987 | 3/1918 | Paige | 510/463 |
| 1,514,494 | 11/1924 | Williams | 510/259 |
| 2,155,045 | 4/1939 | Griffith et al. | 510/259 |
| 2,155,046 | 4/1939 | Griffith et al. | 510/259 |
| 2,575,576 | 11/1951 | Bacon et al. | 510/179 |
| 2,900,222 | 8/1959 | Kahler et al. | 21/2.7 |
| 3,419,502 | 12/1968 | Newman | 252/180 |
| 3,432,428 | 3/1969 | Wirth et al. | 210/29 |
| 3,510,436 | 5/1970 | Silverstein et al. | 252/389 |
| 3,794,603 | 2/1974 | O'Neal, Jr. et al. | 510/259 |
| 3,901,727 | 8/1975 | Loudas | 134/4 |
| 3,910,854 | 10/1975 | Meyer | 510/259 |
| 3,976,617 | 8/1976 | Vasta | 260/39 R |
| 3,994,744 | 11/1976 | Anderle et al. | 134/4 |
| 4,002,571 | 1/1977 | Anderle et al. | 510/406 |
| 4,017,410 | 4/1977 | Sorgenfrei et al. | 510/219 |
| 4,066,398 | 1/1978 | Hwa | 510/259 |
| 4,089,796 | 5/1978 | Harris et al. | 252/181 |
| 4,120,655 | 10/1978 | Crambes et al. | 422/15 |
| 4,125,370 | 11/1978 | Nicol | 8/137.5 |
| 4,324,684 | 4/1982 | Geiger et al. | 252/389 A |
| 4,411,865 | 10/1983 | Geiger et al. | 422/16 |
| 4,438,009 | 3/1984 | Brusky et al. | 510/284 |
| 4,529,451 | 7/1985 | Otrhalek et al. | 148/6.15 Z |
| 4,575,569 | 3/1986 | Edwards | 568/45 |
| 4,606,890 | 8/1986 | Fisk | 422/15 |
| 4,643,778 | 2/1987 | Donofrio | 148/6.15 R |
| 4,902,434 | 2/1990 | Dickerson | 424/76.1 |
| 4,908,148 | 3/1990 | Caravajal et al. | 510/514 |
| 4,917,812 | 4/1990 | Cilley | 510/227 |
| 4,931,205 | 6/1990 | Edwards et al. | 252/174.21 |
| 4,933,101 | 6/1990 | Cilley et al. | 510/222 |
| 4,992,212 | 2/1991 | Corring et al. | 510/255 |
| 5,076,954 | 12/1991 | Loth et al. | 510/417 |
| 5,230,824 | 7/1993 | Carlson, Sr. et al. | 510/506 |
| 5,385,655 | 1/1995 | Brent et al. | 204/181.1 |
| 5,431,836 | 7/1995 | Carr et al. | 510/348 |
| 5,558,109 | 9/1996 | Cala et al. | 134/2 |
| 5,614,027 | 3/1997 | Dunn et al. | 134/2 |

OTHER PUBLICATIONS commonly assigned allowed Ser. No. 08/311,253, issuing as U.S. 5,614,027 on Mar. 25, 1997, Sep. 23, 1994.

Hawley's Condensed Chemical Dictionary (12th ed.), 1993, p. 1247–"Zinc Phosphate" definition.

*Primary Examiner*—Ardith Hertzog
*Attorney, Agent, or Firm*—Irving M. Fishman

[57] ABSTRACT

A metal cleaning composition useful in an aqueous solution comprises an alkali metal salt and a corrosion inhibitor. The corrosion inhibitor is provided in the form of zinc phosphate compounds such as zinc orthophosphate.

25 Claims, No Drawings

ALKALI METAL CLEANER WITH ZINC PHOSPHATE ANTI-CORROSION SYSTEM

BACKGROUND OF THE INVENTION

The present invention relates generally to aqueous metal cleaning compositions. In particular, this invention is directed to aqueous metal cleaning compositions useful in so-called parts washers which are particularly adapted to be used for industrial cleaning, as well as for domestic use.

Parts washers of various kinds are known to those skilled in the art as having great utility for mechanics and others working in a variety of occupations, particularly those working in industrial plants, maintenance and repair services, and the like. The parts washers referred to herein include soak tanks, so-called hot tanks, immersion type parts cleaners with or without air agitation, spray washers (continuous or batch) and ultrasonic baths. Generally, parts washers are used to remove all types of contaminants adhered to the metal surface including greases, cutting fluids, drawing fluids, machine oils, antirust oils such as cosmoline, carbonaceous soils, sebaceous soils, particulate matter, waxes, paraffins, used motor oil, fuels, etc.

Until recently, metal surfaces were cleaned of most oily and greasy contamination by use of solvents. Existing solvents, with or without special additives, are adequate to achieve good cleaning of most dirty, greasy, metal parts. A great number of solvents have been employed to produce metallic surfaces free from contamination. These wash solvents generally include various halogenated hydrocarbons and non-halogenated hydrocarbons, of significant quantity industry wide for cleaning and degreasing of the metal surfaces, and the degree of success with each of these wash solvents is generally dependent upon the degree of cleanliness required of the resultant surface.

Recently, however, the various hydrocarbon and halogenated hydrocarbon metal cleaning solvents previously employed have come under scrutiny in view of the materials employed, and in particular, the environmental impact from the usage of the various materials. This is particularly so in the case of parts cleaning which is done in closed environments such as garages and the like or for even home usage in view of the close human contact. Even the addition of devices to parts washers which can reduce spillage, fire and excessive volatilization of the cleaning solvent are not sufficient to alleviate present environmental concerns.

Although the halogenated hydrocarbon solvents such as chlorofluorocarbons (CFCs) and trichloromethane, methylene chloride and trichloroethane (methyl chloroform) are widely used in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

The non-halogenated hydrocarbon solvents such as toluene and Stoddard solvent and like organic compounds such as ketones and alcohols on the other hand are generally flammable, have high volatility and dubious ability to be recycled for continuous use. These, plus unfavorable safety, environmental and cost factors, put this group of solvents in a category which is unattractive for practical consideration. Most useful organic solvents are classified as volatile organic compounds (VOCs) which pollute the atmosphere, promote formation of toxic ozone at ground level, and add to the inventory of greenhouse gases.

In order to eliminate the various negative aspects of the known chemical washing and degreasing systems, it has, therefore, been suggested that an aqueous detergent system be used so as to overcome some of the inherent negative environmental and health aspects of prior art solvent cleaning systems. Unfortunately, aqueous cleaning systems are not without their own problems as related to use thereof in metal cleaning systems including use in parts washers as described above. For example, certain of the aqueous cleaners are exceedingly alkaline having pHs of 13 and above such as sodium hydroxide or include organic solvents such as alkanolamine, ethers, alcohols, glycols, ketones and the like. Besides being highly corrosive, the exceedingly high alkaline aqueous solutions are highly toxic and can be dangerous to handle requiring extreme safety measures to avoid contact with skin. Organic solvent-containing aqueous cleaners present the problems regarding toxicity, volatility or the environment as expressed previously. On the other hand, it is most difficult to obtain an aqueous detersive solution at moderate pH which is effective in removing the greases and oils which contaminate metal including metal engine parts and which would not be corrosive to the metal substrate.

One particular disadvantage of using aqueous systems to clean metal surfaces is the potential to corrode or discolor the surfaces. While aqueous cleaning solutions having a high pH such as formed from sodium hydroxide are often more corrosive than aqueous solutions having a relatively low pH such as formed by mildly alkaline detergents, corrosion and discoloration are still problematic with the more mild solutions. Various corrosion inhibitors are known and have been used to prevent corrosion of surfaces which come into contact with aqueous alkaline solutions. Probably, the most effective and least costly of the known corrosive inhibitors are the silicates, such as alkali metal silicates. Unfortunately, the alkali metal silicates begin to precipitate from aqueous solution at pHs below 11, thus, greatly reducing the effectiveness of these materials to prevent corrosion of the contacted surfaces when used in aqueous cleaning solutions having a lower pH. Accordingly, to be as effective and be able to replace the halogenated and hydrocarbon solvents now widely used, aqueous metal cleaning compositions will have to be formulated to solve the problems associated therewith including efficacy of detersive action at moderate pH levels and the corrosiveness inherent in aqueous based systems, in particular, on metal substrates.

Accordingly, it is an object of this invention to provide an aqueous metal cleaning composition which is effective to clean grease, oil and other contaminants from a metal surface without being excessively corrosive to the substrate and irritating to human skin.

Another object of the invention is to provide an aqueous metal cleaning composition which can be used effectively in a variety of parts washing equipment so as to efficiently remove grease, oil and other contaminants from metal parts and which is safe to use and not a hazard to the environment in use or upon disposal.

Still another object of the present invention is to provide an aqueous metal cleaning composition which contains an effective corrosion inhibitor.

Still yet another object of the present invention is to provide an aqueous metal cleaning composition of moderate pH which has effective detersive action and which can provide effective corrosion protection to the metal substrate being cleaned.

A further object of this invention is to provide a method of imparting corrosion protection to metal surfaces from aqueous solution.

SUMMARY OF THE INVENTION

The above-mentioned objectives and other objects are obtained in accordance with the present invention by providing an aqueous alkali metal cleaning solution which has a pH of up to 11 but a sufficiently high pH to effectively clean dirt, grease, oil and the like from metal parts and which includes a metal corrosion inhibitor effective in mildly alkaline aqueous solutions. Zinc phosphate has surprisingly been found to be effective as a corrosion inhibitor in alkali metal aqueous solutions. Additionally, magnesium ions, preferably as magnesium sulfate, can be added to an alkali metal aqueous solution with zinc phosphate to provide further corrosion protection for metal substrates. Unlike cleaning preparations containing halogenated or hydrocarbon solvents, aqueous alkali cleaning solutions of this invention are environmentally safe in use and have only low amounts of organics which do not readily volatilize and which are safe on disposal thereof.

The aqueous metal cleaning compositions of the present invention comprise an alkali metal salt and zinc phosphate or zinc phosphate in combination with magnesium ions. The addition of a polycarboxylated polymer has been found useful in preventing precipitation of zinc phosphate and magnesium ions from mildly alkaline solutions of this invention. Preferably, the detersive ability of the aqueous alkaline cleaning composition is enhanced by the addition of a surfactant. Particularly useful surfactants which can be used in cleaning compositions of this invention are ones which are low foaming and do not readily emulsify the oil and grease being removed so as to allow such grease and oil to be skimmed from the wash bath for disposal. Consequently, the cleaning ability of the aqueous cleaner can be maintained for prolonged reuse.

DETAILED DESCRIPTION OF THE INVENTION

The aqueous cleaning compositions of the present invention comprise an alkali metal salt and a zinc phosphate corrosion inhibitor.

The metal cleaning compositions of the present invention are useful for removing any type of contaminant from a metal surface including greases, cutting fluids, drawing fluids, machine oils, antirust oils such as cosmoline, carbonaceous soils, sebaceous soils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein the metal surfaces have to be cleaned.

Treatment of aluminum surfaces with the compositions of this invention has been found particularly effective.

The aqueous alkali metal cleaning solutions of this invention comprising the cleaning composition in water have a pH above 7.5 and up to 11.0 so as to render these solutions substantially less harmful to use and handle than highly alkaline aqueous cleaners such as those formed from sodium hydroxide or aqueous alkanolamine solutions. The solutions preferably have a pH of at least 8.0 to less than 11.0 to effectively clean the typical metal substrates. Most preferably, the aqueous alkaline cleaning solutions have a pH from about 8.0 to 10.0 which is effective to remove the dirt, grease, oil and other contaminants from the metal surface without causing tarnishing or discoloration of the metal substrate and yet allow the solutions to be used, handled and disposed of without burning or irritating human skin. It is preferable that the compositions and resultant aqueous cleaning solutions formed therefrom be free of organic solvents including hydrocarbon, halohydrocarbon and oxygenated hydrocarbon solvents.

Alkali providing agents of the aqueous metal cleaning compositions of the present invention can be provided by one or more alkali metal salts. Suitable alkali metal salts or mixtures thereof useful in the present invention are those capable of providing the desired pH. Most suitable are the salts of potassium and sodium. Especially preferred are the potassium and sodium carbonates and bicarbonates which are economical, safe and environmentally friendly. The carbonate salts include potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Other suitable alkali metal salts which can be used include the alkali metal ortho or complex phosphates. Examples of alkali metal orthophosphates include trisodium or tripotassium orthophosphate. The complex phosphates are especially effective because of their ability to chelate water hardness and heavy metal ions. The complex phosphates include, for example, sodium or potassium pyrophosphate, tripolyphosphate and hexametaphosphates. It is preferred to limit the amount of phosphates to less than 1 wt. % (phosphorus) relative to the total alkaline salts used inasmuch as phosphates are ecologically undesirable being a major cause of eutrophication of surface waters. Additional suitable alkaline salts useful in the metal cleaning compositions of this invention include the alkali metal borates, acetates, citrates, tartrates, succinates, phosphonates, edates, etc. It is preferred to maintain the compositions of this invention silicate-free due to the resultant high pH and difficulty in formulating a composition which will remain soluble in aqueous solution at pH's of 11.0 or less when silicates are present.

The corrosion inhibitor added to the aqueous metal cleaning compositions of this invention include zinc phosphate or zinc phosphate in combination with magnesium ions. Preferably, zinc phosphate is provided in a water soluble form. An example of a useful water soluble form of zinc phosphate is zinc orthophosphate.

Any suitable source of magnesium ions can be added to the alkali metal compositions to practice this invention. A preferred source of magnesium ions is water soluble magnesium sulfate. Other suitable sources of magnesium ions include, but are not limited to, water soluble salts of chlorides, nitrates and oxides of magnesium.

Zinc phosphate can be formed in situ in compositions of the present invention. Thus, zinc and phosphate can be added as separate salts to make the compositions of the present invention. Phosphate, such as orthophosphate, can be provided as an addition product, such as, sodium orthophosphate, or as a precursor compound such as complex inorganic phosphates, organic phosphates or organic phosphonates which revert to orthophosphate in water.

Illustrative examples of orthophosphate as an actual addition are monosodium phosphate and monopotassium phosphate. Any other water soluble orthophosphate or phosphoric acid also would be considered suitable.

Complex inorganic phosphates which are suitable to practice this invention include, but are not limited to, sodium tripolyphosphate, sodium tetraphosphate, sodium septaphosphate, sodium decaphosphate and sodium hexametaphosphate. Either the corresponding potassium or ammonium salts or the corresponding molecularly dehydrated phosphoric acids such as metaphosphoric acid or pyrophosphoric acid are suitable.

Organic phosphonates which can be employed to practice this invention include, but are not limited to, aminotrimethylene phosphonic acid, hydroxyethylidene diphosphonic acid and water soluble salts thereof.

Organic phosphates are exemplified in U.S. Pat. No. 3,510,436, of which the entire disclosure is hereby incorporated herein by reference.

When a phosphate such as orthophosphate is provided as an actual additive, zinc can be added to the compositions as such water soluble compounds as zinc oxide, zinc acetate, zinc chloride, zinc formate, zinc nitrate, zinc sulphate, zinc borate, zinc chromate, zinc dichromate, and the like.

In order to assist in maintaining the dispersibility of zinc phosphate and magnesium corrosion inhibitors in aqueous solution, in particular, under the mildly alkaline pH conditions most useful in this invention and in the presence of agents which would otherwise cause precipitation of zinc phosphate or magnesium ions, e.g., carbonates, phosphates, etc., it has been found advantageous to include a carboxylated polymer to the solution. The useful carboxylated polymers may be generically categorized as water-soluble carboxylic acid polymers such as polyacrylic and polymethacrylic acids or a vinyl addition polymers. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersable in water. The molecular weight of these polymers may vary over a broad range although it is preferred to use polymers having average molecular weights ranging between 1,000 up to 1,000,000. In a preferred embodiment of the invention these polymers have a molecular weight of 100,000 or less and, most preferably, between 1,000 and 10,000.

The water-soluble polymers of the type described above are often in the form of copolymers which are contemplated as being useful in the practice of this invention provided they contain at least 10% by weight of

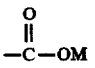

groups where M is hydrogen, alkali metal, ammonium or other water-solubilizing radicals. The polymers or copolymers may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502 which is hereby incorporated herein in its entirety by reference.

As previously stated, maleic anhydride polymers are preferred. Especially useful maleic anhydride polymers are selected from the group consisting of homopolymers of maleic anhydride, and copolymers of maleic anhydride with vinyl acetate, styrene, ethylene, isobutylene, acrylic acid and vinyl ethers. These polymers can be easily prepared according to standard methods of polymerization.

The carboxylated polymers aid in maintaining the magnesium and zinc phosphates in solution, thereby preventing the precipitation of the corrosion inhibitor from solution and consequent degradation of corrosion protection. Further, the carboxylated polymers prevent scaling due to precipitation of water hardness salts formed during reaction with the alkaline salts of the cleaning compositions of this invention.

To improve cleaning efficacy of the cleaning compositions of the present invention, it is preferred to add one or more surfactants. Nonionic surfactants are preferred as such surfactants are best able to remove the dirt, grease and oil from the metal substrates.

Among the most useful surfactants in view of the ability thereof to remove grease and oil are the nonionic alkoxylated thiol surfactants. The nonionic alkoxylated (ethoxylated) thiol surfactants of the present invention are known and are described for example in U.S. Pat. Nos. 4,575,569 and 4,931,205, the contents of both of which are herein incorporated by reference. In particular, the ethoxylated thiol is prepared by the addition of ethylene oxide to an alkyl thiol of the formula R—SH wherein R is alkyl in the presence of either an acid or base catalyst. The thiol reactant that is suitable for producing the surfactant used in the practice of the present invention comprises, in the broad sense, one or more of the alkane thiols as have heretofore been recognized as suitable for alkoxylation by reaction with alkylene oxides in the presence of basic catalysts. Alkane thiols in the 6 to 30 carbon number range are particularly preferred reactants for the preparation of thiol alkoxylates for use as surface active agents, while those in the 7 to 20 carbon number range are considered more preferred and those in the 8 to 18 carbon number range most preferred.

Broadly, the surfactant can be formed from reaction of the above alkyl thiol and one or more of the several alkylene oxides known for use in alkoxylation reactions with thiols and other compounds having active hydrogen atoms. Particularly preferred are the vicinal alkylene oxides having from 2 to 4 carbon atoms, including ethylene oxide, 1,2-propylene oxide, and the 1,2- and 2,3-butylene oxides. Mixtures of alkylene oxides are suitable in which case the product will be mixed thiol alkoxylate. Thiol alkoxylates prepared from ethylene or propylene oxides are recognized to have very advantageous surface active properties and for this reason there is a particular preference for a reactant consisting essentially of ethylene oxide which is considered most preferred for use in the invention.

The relative quantity of thiol and alkylene oxide reactants determine the average alkylene oxide number of the alkoxylate product. In the alkoxylated thiol surfactant of this invention an adduct number in the range from about 3 to 20, particularly from about 3 to 15 is preferred. Accordingly, preference can be expressed in the practice of the invention for a molar ratio of alkylene oxide reactant to thiol reactant which is in the range from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Unfortunately, the ethoxylated thiol surfactant has an unpleasant odor which is imparted to the aqueous solution in which it is placed. It has been found that the addition of a nitrogen-containing surfactant eliminates the odor of the sulfur-containing surfactant and does not adversely effect the efficacy of the ethoxylated thiol surfactant to remove grease, oil and the like from the metal surfaces. Among useful nitrogen-containing nonionic surfactants are the following:

A surfactant having a formula $R^1R^2R^3N \rightarrow 0$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and $R^3$ are selected from the group consisting of alkyl radicals and hydroxyalkyl radicals containing from one to about three carbon atoms.

Specific examples of amine oxide surfactants include: Dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropyl amine oxide, (2-hydroxypropyl) methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, nonionic surfactants derived from the condensation of ethylene oxide with the product resulting from the reaction of propylene oxide and ethylene diamine are also useful. For example, compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000 are satisfactory.

One of the most useful nitrogen-containing surfactants are those derived from N-alkyl pyrrolidone. This surfactant is one which can be used alone to achieve excellent cleaning or used in combination with the ethoxylated thiol surfactant. Particularly preferred is N-(n-alkyl)-2-pyrrolidone wherein the alkyl group contains 6–15 carbon atoms. These compounds are described in U.S. Pat. No. 5,093,031, assigned to ISP Investments, Inc., Wilmington, Del. and which discloses surface active lactams and is herein incorporated by reference. The above N-alkyl pyrrolidone products having a molecular weight of from about 180 to about 450 are conveniently prepared by several known processes including the reaction between a lactone having the formula

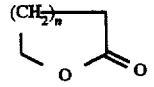

wherein n is an integer from 1 to 3, and an amine having the formula $R'—NH_2$ wherein R' is a linear alkyl group having 6 to 20 carbon atoms. The amine reactant having the formula $R'—NH_2$ includes alkylamines having from 6 to 20 carbon atoms; amines derived from natural products, such as coconut amines or tallow amines distilled cuts or hydrogenated derivatives of such fatty amines. Also, mixtures of amine reactants can be used in the process for preparing the pyrrolidone compounds.

Generally, the $C_6$ to $C_{14}$ alkyl pyrrolidones have been found to display primarily surfactant properties; whereas the $C_{16}$ to $C_{22}$ alkyl species are primarily complexing agents; although some degree of surfactants and complexing capability exists in all of the present species.

The relative amounts of the ethoxylated thiol surfactant and nitrogen-containing surfactant if used in combination are not overly critical as far as a contrite range is concerned in that the amount of the nitrogen surfactant will vary depending on the surfactant used. The amount of nitrogen-containing surfactant used should be that which can reduce if not eliminate the odor of the ethoxylated thiol surfactant. In general, it is believed that the relative amounts by weight of the ethoxylated thiol surfactant to the nitrogen-containing surfactant should range from about 1.0:0.1 to 1.0:2.0, and preferably from about 1.0:0.2 to 1:1. It is not meant that these ratios are to be considered as strictly limiting the invention and as providing the only relative amounts of the respective surfactants which can be effectively used and accordingly, it is intended that any useful ratio be considered part of the present invention. Any useful ratio is that ratio which is sufficient to remove the dirt, grease, oil and other contaminants from the metal surface and which will yield an aqueous product which has greatly reduced malodor relative to an equivalent composition in which the ethoxylated thiol surfactant is present and the nitrogen-containing surfactant is not.

Other surfactants can be used in the compositions of this invention other than or in addition to the above described surfactants. Especially preferred are surfactants which do not readily emulsify the contaminants removed from the metal surface so that such contaminants readily separate from the cleaning solution. The separated contaminants can then be easily skimmed or otherwise easily separated from the wash bath for disposal. Consequently, the cleaning ability of the aqueous cleaner can be maintained for prolonged reuse. It is believed that most of the ethoxylated surfactants do not substantially emulsify the removed contaminants.

Suitable non-ionic surfactants include the polyoxyethylene-polyoxypropylene condensates, which are sold by BASF under the tradename "Pluronic", polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide. Examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate sold by W. R. Grace under the tradename "Hamposyl". Also effective are polycarboxylated ethylene oxide condensates of fatty alcohols manufactured by Olin under the tradename of "Polytergent CS-1". It is most preferred that the aqueous cleaning solutions of this invention be low foaming during use. Accordingly, the sulfate and sulfonate surfactants may not always be acceptable if the cleaning process involves agitation of the cleaning solution.

Besides the alkalinity providing agent corrosion inhibitor and optional carboxylated polymer and surfactant as described above, the aqueous metal cleaning compositions of the present invention preferably include a hydrotrope. In use, the dry ingredients of the invention are provided in solution in water which is preferably deionized or purified by reverse osmosis treatment and the like.

The hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam. Among the most useful of such hydrotropes are those which comprise the alkali metal salts of intermediate chain length linear alkyl monocarboxylic fatty acids, i.e., $C_7$–$C_{13}$. Particularly preferred are the alkali metal octanoates and nonanoates.

The metal cleaning compositions of this invention comprise from about 1 to about 60 weight percent, preferably, from about 3 to about 30 weight percent, most preferably, from about 5 to about 15 weight percent of an alkali metal salt based on the dry components, about 0.1 to about 10 weight %, preferably, from about 2 to about 5 weight % of a corrosion inhibitor compound based on the dry components, from about 5 to about 20 weight % of a surfactant, 0 to about 10 weight percent, preferably, about 1 to about 5 weight percent of a polycarboxylate and 0 to about 60 weight percent, preferably, about 2 to about 30 weight percent of a hydrotrope all based on dry components of the compositions. Most preferably, the metal cleaning compositions of the present invention are provided and added to the wash bath as an aqueous concentrate in which the dry components of the composition comprise from about 5–40 weight percent of the concentrate, preferably from about 10–30 weight percent. The dry composition is used in the aqueous wash solution in amounts of about 0.1–10 weight percent, preferably from about 0.2–5 weight percent.

If the alkali metal salt is the preferred carbonate or bicarbonate salt, such salts are preferably present in amounts of about 15–60 percent by weight of the dry components. Preferably, if a combination of such salts is utilized the amount of bicarbonate salts preferably comprises from about 5–60 weight percent and the carbonate salts preferably from about 5–40 weight percent based on the dry composition.

Individually, the magnesium and zinc phosphate corrosion inhibitors are added to the compositions in different amounts. Thus, the magnesium compound will typically be added to dry composition in amounts of about 0.1 to about 10 weight %, preferably from about 2 to about 4 weight %, whereas zinc phosphate can be present in amounts of from about 0.1 to about 1.5 weight % of a dry composition, preferably 0.8 to about 1.0 weight % of a dry composition. Thus, useful levels of magnesium ion for producing an anticorrosive effect are between about 25 and 1,500 ppm with respect to the aqueous concentrate. It is preferable to use between about 50 and 200 ppm of magnesium in concentrates. It is to be understood that higher levels of the magnesium ion can be included in the aqueous concentrate but for the most part, higher levels than that described are not believed to add significantly to the anticorrosive effect. Zinc phosphate is effective at concentrations between 1 and 1,000 ppm, preferably from about 10 ppm to about 1,000 ppm, with respect to the aqueous concentrate. Again, higher levels of zinc phosphate can be used but such higher levels are not believed to increase the anticorrosive effect. When used alone, zinc phosphate is preferably utilized in concentrations of about 25 to 100 ppm in the concentrate. When used with magnesium, zinc phosphate levels are preferably from about 2 to 25 ppm based on the concentrate.

The aqueous metal cleaning compositions of the present invention are useful in removing a variety of contaminants from metal substrates as previously described. A useful method of cleaning such metal parts is in a parts washer. In parts washers the metal parts are contacted with the aqueous compositions either by immersion or some type of impingement in which the aqueous cleaning composition is circulated or continuously agitated against the metal part or is sprayed thereon. Alternatively, agitation can be provided as ultrasonic waves. The cleaning composition is then filtered and recycled for reuse in the parts washer.

For best use, the aqueous cleaning compositions of this invention are preferably at an elevated temperature typically ranging from about 90°–180° F. The contact time of the aqueous cleaning composition with the metal substrates will vary depending upon the degree of contamination but broadly will range between about 1 minute to about 30 minutes with about 3 minutes to about 15 minutes being more typical.

ALKALI METAL CLEANER EXAMPLE I AND CONTROL EXAMPLES I AND II

The following examples show the effectiveness of zinc phosphate in preventing corrosion and discoloration of aluminum surfaces when exposed to alkaline solutions.

Initially aluminum metal test coupon types 2024 and 7075 are accurately weighed on a balance. The test coupons then are immersed for 24 hours in aqueous concentrates of test products held at 160° F. The coupons are recovered from the test concentrates, thoroughly rinsed in distilled water and allowed to dry. The coupons then are reweighed and examined for signs of corrosion.

The test products as aqueous concentrates and results of testing for each of the examples and controls are shown in Tables 1 and 2 (concentrates) and Table 3 (results). In Table 3, negative numbers indicate weight loss, therefore, corrosion. Positive numbers indicate weight gain, therefore, deposition.

TABLE 1

| Alkali Metal Cleaner Example (% Weight) | |
|---|---|
| Water | 79.03 |
| Pot. bicarbonate | 7.00 |
| Potassium carbonate | 0.62 |
| Genapol 2222 | 1.00 |
| $MgSO_4$ heptahydrate | 0.50 |
| Zinc Phosphate | 0.10 |
| Alcosperse 2310[1] | 1.75 |
| Monotrope 1250[2] | 6.50 |
| Alcodet 260[3] | 1.00 |
| ISP LP-100[4] | 1.50 |
| Olin SL 92 | 1.00 |

[1]Acrylic acid polymer, MW 2,500–4,500, Alco Chemical Corp., Chattanooga, TN
[2]Monotrope 1250 is a tradename and consists of a solution of sodium nonanoate.
[3]Ethoxylated dodecyl mercaptan (6 ethylene oxide units), Rhone-Poulenc.
[4]N-alkyl pyrrolidone, ISP

TABLE 2

| | Controls (% Weight) | |
|---|---|---|
| | I | II |
| Water | 79.16 | 83.59 |
| Sodium hydroxide | 0.00 | 0.40 |
| Pot. bicarbonate | 10.00 | 0.00 |
| Potassium carbonate | 1.96 | 7.81 |
| Genapol 2222 | 1.00 | 1.00 |
| $MgSO_4$ heptahydrate | 0.50 | 0.50 |
| Zinc Phosphate | 0.00 | 0.00 |
| Alco 2310 | 1.75 | 1.75 |
| Carbopol Ex 368 | 0.00 | 0.45 |
| Potassium silicate | 0.00 | 1.00 |
| Alcodet 260 | 3.75 | 0.00 |
| ISP LP-100 | 1.88 | 2.00 |
| Olin SL-92 | 0.00 | 1.50 |

TABLE 3

| | Weight Change Aluminum Type | | | Visual appearance Aluminum Type | |
|---|---|---|---|---|---|
| | 2024 | 7075 | pH | 2024 | 7075 |
| Example | 0.000 | +0.0002 | 8.5 | No discoloration | sl. iridescent |
| | −0.0004 | +0.0002 | 8.5 | No discoloration | sl. iridescent |
| Control I | −0.0027 | −0.0016 | 8.2 | brown | brown |
| | −0.0031 | −0.0022 | 8.2 | brown | brown |
| Control II | −0.0003 | 0.000 | 11.0 | No discoloration | No discoloration |
| | −0.0005 | −0.0006 | 11.0 | No discoloration | No discoloration |

Referring to Table 3, the results show that the Example formulations of the present invention containing zinc phosphate are less corrosive to aluminum than the Control formulations which did not contain zinc phosphate. Both Controls I and II show an overall decrease in weight of aluminum coupons after 24 hours of soaking in the control concentrates in contrast to weight gain on aluminum coupons soaked in an alkali metal solution containing zinc phosphate. Moreover, aluminum coupons soaked in the concentrate of Control I have brown deposits, i.e., rust. Further, the anti-corrosive effects of zinc phosphates are better than with that of silicates (Control II). Although aluminum coupons soaked in Control II concentrate do not show any discoloration, the coupons show a net weight loss indicating corrosion in contrast to weight gain in aluminum coupons soaked in alkali metal concentrate containing zinc phosphate indicating metal deposition. The use of zinc phosphate prevents discoloration of aluminum in addition to providing an anticorrosive effect.

ALKALI METAL CLEANER EXAMPLE II AND CONTROL EXAMPLES III and IV

The following example disclosed in Table 4 shows an additional zinc phosphate cleaning composition which prevents corrosion and discoloration of aluminum surfaces when exposed to alkaline solutions.

Aluminum metal test coupon types 2024 and 7075 are immersed for 24 hours in aqueous concentrates of test products held at 160° F. After 24 hours the test coupons are removed from the alkaline solutions and closely scrutinized for rust deposits. No rust deposits are observed, thus the formula of Table 4 shows anticorrosion activity.

TABLE 4

| Alkali Metal Cleaner Example (% Weight) | |
|---|---|
| Water | 78.75 |
| Pot. bicarbonate | 8.70 |
| Potassium carbonate | 0.50 |
| Sodium Carbonate | 0.45 |
| MgO | 0.074 |
| Alcosperse 2310[1] | 0.50 |
| Monotrope 1250[2] | 6.50 |
| Alcodet 260[3] | 3.00 |
| ISP LP-100[4] | 1.50 |
| $Zn3(PO_4)_2 5H_2O$ | 0.024 |

[1]Acrylic acid polymer, MW 2,500–4,500, Alco Chemical Corp., Chattanooga, TN
[2]Monotrope 1250 is a tradename and consists of a solution of sodium nonanoate.
[3]Ethoxylated dodecyl mercaptan (6 ethylene oxide units), Rhone-Poulenc.
[4]N-alkyl pyrrolidone, ISP

What is claimed is:

1. An aqueous metal cleaning concentrate comprising: about 5–40 wt. % of a metal cleaning composition and the balance water, the metal cleaning composition comprising an alkali metal salt, a water soluble salt of magnesium, and a zinc phosphate corrosion inhibitor.

2. The concentrate of claim 1, wherein the zinc phosphate is a zinc orthophosphate.

3. The concentrate of claim 1, wherein the alkali metal salt comprises alkali metal carbonate, alkali metal bicarbonate or mixtures thereof.

4. The concentrate of claim 1, wherein the water soluble salt of magnesium comprises magnesium oxide, magnesium chloride or magnesium sulfate.

5. The concentrate of claim 1, which has a pH of about 7.5 to 11.0.

6. The concentrate of claim 1, wherein the metal cleaning composition further includes a surfactant.

7. The concentrate of claim 6, wherein the surfactant is a nonionic surfactant.

8. The concentrate of claim 6, wherein the surfactant comprises an alkoxylated thiol.

9. The concentrate of claim 7, further including a nitrogen-containing surfactant.

10. The concentrate of claim 9, wherein the nitrogen-containing surfactant is an N-alkyl pyrrolidone.

11. The concentrate of claim 1, wherein the metal cleaning composition comprises about 1 to about 60 wt. % of the alkali metal salt, about 0.1 to about 1.5 wt. % of the zinc phosphate, from about 5 to about 20 wt. % of a surfactant, and from 0 to about 60 wt. % of a hydrotrope.

12. The concentrate of claim 11, wherein the metal cleaning composition further comprises from 0 to about 10 wt. % of a carboxylated polymer.

13. The concentrate of claim 11, wherein the metal cleaning composition is free of silicates.

14. A metal cleaning composition comprising: an alkali metal salt, a water soluble salt of magnesium, and a zinc phosphate corrosion inhibitor.

15. The composition of claim 14, wherein the water soluble salt comprises magnesium chloride, magnesium sulfate or magnesium oxide.

16. The composition of claim 14, wherein the alkali metal salt comprises alkali metal carbonate, alkali metal bicarbonate or mixtures thereof.

17. The composition of claim 14, comprising from about 1 to about 60 wt. % of the alkali metal salt, from about 0.1 to about 1.5 wt. % of the zinc phosphate, from 5 to about 20 wt. % of a surfactant, from about 0 to about 10 wt. % of a carboxylated polymer and from 0 to about 60 wt. % of a hydrotrope.

18. The composition of claim 17, wherein the surfactant comprises an ethoxylated alkyl thiol having 7 to 20 carbon atoms and is ethoxylated with 3 to 15 ethylene oxide units.

19. The composition of claim 18, further including a nitrogen-containing surfactant.

20. The composition of claim 17, wherein the surfactant is a nonionic surfactant.

21. The composition of claim 19, wherein the ethoxylated alkyl thiol surfactant is present in the composition in amounts relative to the nitrogen-containing surfactant of from about 1.0:0.1 to 1.0:2.0 based on the weight of the respective surfactants.

22. The composition of claim 19, wherein the nitrogen-containing surfactant is an N-alkyl pyrrolidone.

23. The composition of claim 17, wherein the carboxylated polymer comprises acrylic acid units.

24. The composition of claim 17, wherein the carboxylated polymer comprises a copolymer having maleic anhydride units.

25. The composition of claim 17, wherein the metal cleaning composition is free of silicates.

* * * * *